US007704096B2

(12) United States Patent
Liao et al.

(10) Patent No.: US 7,704,096 B2
(45) Date of Patent: Apr. 27, 2010

(54) COAXIAL CABLE CONNECTOR

(75) Inventors: Yen-Jang Liao, Taoyuan Hsien (TW); Chuan-Shien Yu, Taipei (TW); Ken Hsieh, Taoyuan Hsien (TW)

(73) Assignee: Speed Tech Corp., Taoyuan Hsien (TW)

( * ) Notice: Subject to any disclaimer, the term of this patent is extended or adjusted under 35 U.S.C. 154(b) by 26 days.

(21) Appl. No.: 12/003,790

(22) Filed: Dec. 31, 2007

(65) Prior Publication Data

US 2008/0293299 A1 Nov. 27, 2008

(30) Foreign Application Priority Data

Mar. 2, 2007 (TW) ..... 96203496 U

(51) Int. Cl.
*H01R 9/05* (2006.01)

(52) U.S. Cl. ..... 439/582

(58) Field of Classification Search ..... 439/578–595, 439/394

See application file for complete search history.

(56) References Cited

U.S. PATENT DOCUMENTS 5,263,877 A * 11/1993 Mitani ..... 439/585
5,879,190 A * 3/1999 Maruyama et al. ..... 439/582
6,155,890 A * 12/2000 Gerberding ..... 439/835
6,508,668 B1 * 1/2003 Yamane ..... 439/582
6,712,645 B1 * 3/2004 Chou ..... 439/582
6,739,907 B2 * 5/2004 Kuroda et al. ..... 439/582
6,790,082 B2 9/2004 Obayashi ..... 439/582
6,893,286 B2 * 5/2005 Drewes et al. ..... 439/441
7,351,067 B2 * 4/2008 Chen et al. ..... 439/63
2006/0063420 A1 * 3/2006 Reibke et al. ..... 439/441
2007/0072481 A1 * 3/2007 Edenharter ..... 439/441

* cited by examiner

*Primary Examiner*—Renee Luebke
*Assistant Examiner*—Larisa Tsukerman
(74) *Attorney, Agent, or Firm*—Thomas, Kayden, Horstemeyer & Risley

(57) ABSTRACT

A coaxial cable connector including an insulating housing, a terminal and a conductive shell is provided. The insulating housing has an insulating arm disposed thereon. The terminal is disposed in the insulating housing. A portion of the terminal is bent towards the insulating arm to form a tongue portion and an opening thereon. The conductive shell includes a body and a bending portion. The body holds the insulating housing. The bending portion and the tongue portion are located on a side and a reverse side of the insulating arm respectively. The bending portion is capable of pressing the tongue portion by the insulating arm to press the tongue portion toward the opening and to connect the tongue portion to an internal conductor of a coaxial cable so as to press the internal conductor into the opening.

15 Claims, 3 Drawing Sheets

COAXIAL CABLE CONNECTOR

RELATED APPLICATIONS

The present application is based on, and claims priority from, Taiwan Application Serial Number 96203496, filed Mar. 2, 2007, which is herein incorporated by reference.

FIELD OF THE INVENTION

The present invention generally relates to a connector. More particularly, this invention relates to a coaxial cable connector.

BACKGROUND OF THE INVENTION

Since communication technology is highly developed, the communication manufacture is popularly used in the world. In the communication industry, the coaxial cable connector is an indispensable component to the communication products.

Refer to U.S. Pat. No. 6,790,082, a conventional micro coaxial cable connector is disclosed therein. The micro coaxial cable connector is composed of a terminal, an insulating housing, and a conductive shell. When a coaxial cable is disposed on the micro coaxial cable connector, the terminal of the micro coaxial connector is in touch with the internal conductor of the coaxial cable. The micro coaxial connector further utilizes the conductive shell to press the insulating housing, and such that the insulating housing therefore presses on the terminal to force a pair of contacts of the terminal close to each other, and, finally, so as to clamp the internal conductor of the coaxial cable. Therefore, the conductive shell can force the terminal being electrically connected to the internal conductor through the insulating housing.

However, the internal conductor is normally composed by a round wire so that the pair of contacts of the terminal are difficult to firmly clamp the internal conductor. Therefore, the contacts of the terminal have to clamp the internal conductor with a great clamping force. At least, the clamping force has to be large enough to prevent the internal conductor escaping from the contacts of the terminal when the user tries to couple the conductor with a corresponding connector so as to pull and drag the coaxial cable. As a result, because the pair of contacts have to maintain the electrical connection between the pair of contacts of the terminal of the micro coaxial connector and the internal conductor of the coaxial cable, the internal conductor of the coaxial cable is plastically deformed by the pair of contacts of the terminal of the micro coaxial connector due to the pressing force from the conductive shell and through the insulating housing. That is to say, a plurality of abnormal plastic deformation regions may be generated on the internal conductor of the coaxial cable along a direction perpendicular to the contact area between the pair of contacts of the terminal of the micro coaxial connector and the internal conductor of the coaxial cable. The abnormal plastic deformation regions therefore reduce the diameter of the internal conductor and also reduce the mechanical strength of the internal conductor so that the internal conductor can be easily broken therefrom.

Accordingly, there is a need to provide a coaxial cable connector that can effectively prevent from the breakage due to the plastic deformation.

SUMMARY OF THE INVENTION

One object of the present invention is to provide a coaxial cable connector to maintain the electrical connection between a terminal and an internal conductor of a coaxial cable when the coaxial cable connector is coupled to the coaxial cable.

Another object of the present invention is to provide a coaxial cable connector to prevent abnormal plastic deformation on an internal conductor of a coaxial cable when the coaxial cable connector is coupled to the coaxial cable.

To achieve these and other advantages and in accordance with the purpose of the present invention, as the embodiment broadly describes herein, the present invention provides a coaxial cable connector including an insulating housing, a terminal and a conductive shell. The insulating housing has an insulating arm disposed thereon. The terminal is disposed in the insulating housing and one portion of the terminal is bent along an extending direction of the insulating arm to form a tongue portion, a jaw portion and an opening on the terminal. One end of the tongue portion is connected to the terminal and the other end of the tongue portion is protruding on one side of the opening. The conductive shell has a body and a bending portion connected to the body. The body substantially holds the insulating housing. The bending portion is disposed behind the insulating arm while the tongue portion is disposed in front of the insulating arm. When a coaxial cable is disposed on the coaxial cable connector and an internal conductor of the coaxial cable is disposed between the tongue portion and the opening of the terminal, the bending portion of the conductive shell can be pressed on the insulating arm of the insulating housing and the tongue portion of the terminal so as to press the tongue portion toward the opening of the terminal to connect with the internal conductor of the coaxial cable, and therefore the internal conductor of the coaxial cable is clamped by the tongue portion and the jaw portion of the terminal of the coaxial cable connector.

The coaxial cable connector, according to the present invention, can utilize the tongue portion of the terminal to suitably press the internal conductor of the coaxial cable, and then bend the internal conductor, and then keep the electrical connection between the internal conductor and the terminal. Therefore, the terminal can be firmly and electrically connected to the internal conductor, and the breakage probability and the abnormal plastic deformation on the internal conductor can also be effectively reduced.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DETAILED DESCRIPTION OF THE PREFERRED EMBODIMENT

The following description is of the best presently contemplated mode of carrying out the present invention. This description is not to be taken in a limiting sense but is made merely for the purpose of describing the general principles of the invention. The scope of the invention should be determined by referencing the appended claims.

Figure 1:
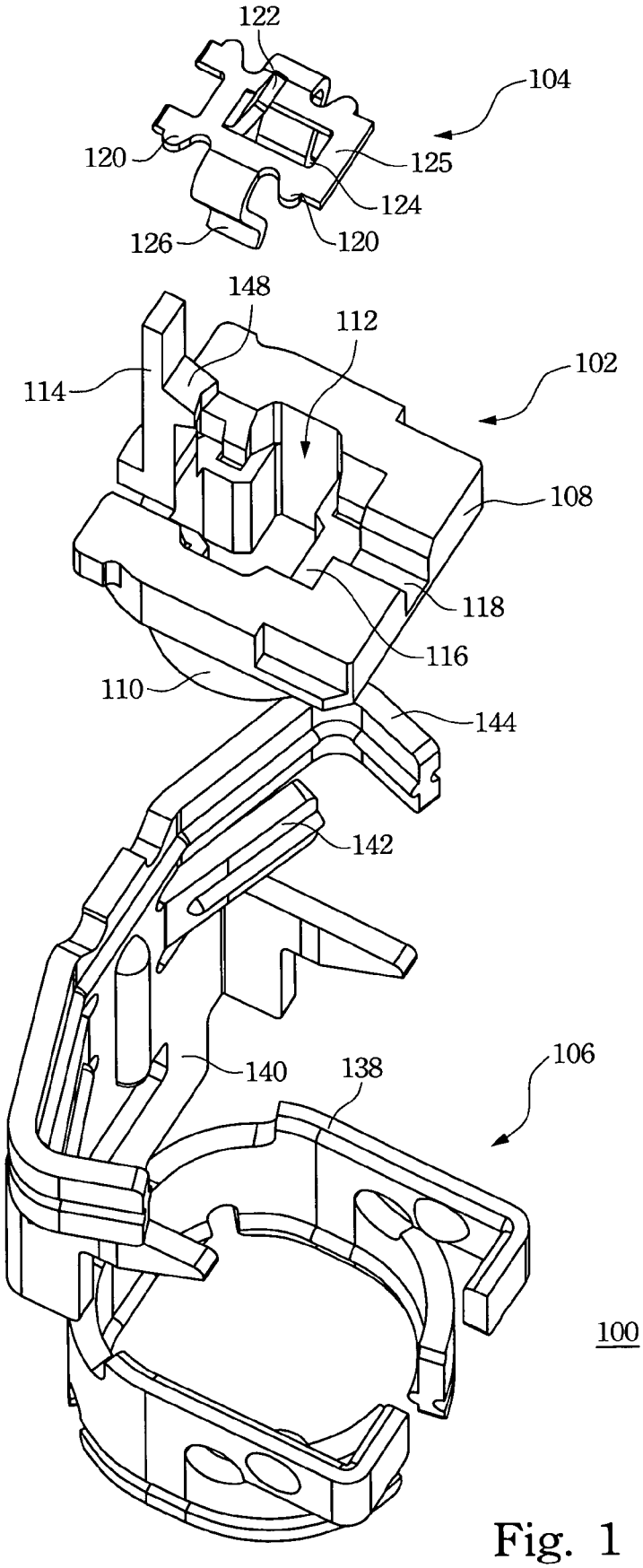
FIG. 1 illustrates an exploded view of a preferred embodiment of a coaxial cable connector according to the present invention.

FIG. 1 is an exploded view of a preferred embodiment of a coaxial cable connector according to the present invention. The coaxial cable connector 100 includes an insulating housing 102, a terminal 104 and a conductive shell 106. The insulating housing 102 is made of an insulating material, for example, a plastic material. The terminal 104 and the conductive shell 106 are made of a conductive material, for example, a metal material.

In detail, the insulating housing 102 includes a base 108, and an annular portion 110 connected to the base 108, and an opening 112 penetrating through the base 108 and the annular portion 110. The base 108 has an insulating arm 114, a terminal container 116 and a wire trench 118 disposed thereon. The insulating arm 114 and the wire trench 118 are disposed on opposite sides of the terminal container 116. The insulating arm 114 and the annular portion 110 are disposed on opposite surfaces of the base 108, for example, a top surface and a bottom surface of the base 108.

The terminal 104 can be disposed inside the terminal container 116, the conductive shell 106 can cover the insulating housing 102, and the insulating housing 102 can fix a position of the terminal 104 relative to the conductive shell 106 to prevent the electrical connection between the terminal 104 and the conductive shell 106. For a more detailed description, the terminal 104 has at least one interference portion 120 disposed thereon and extended toward the outside of the terminal 104. The interference portion 120 can be locked to the insulating housing 102 so that the terminal 104 can be firmly fixed in the insulating housing 102. It is worth noticing that the terminal 104, for example, is made of a metal sheet and a portion thereof is bent toward the insulating arm 114 to form a tongue portion 122 and an opening 124. The tongue portion 122 protrudes on one side of the opening 124. For example, a rectangular area of the terminal 104 is cut off three edges therein and bent up to form a tongue portion 122, a opening 124 and a jaw portion 125. One end of the tongue portion 122 is still connected to the terminal 104 and adjacent to the interference portion 120. The tongue portion 122 and the jaw portion 125 are disposed on opposite sides of the opening 124 respectively. In addition, the tongue portion 122 is not limited to be rectangular, and its shape depends on actually demand. When the terminal 104 is disposed in the insulating housing 102, the insulating arm 114, the tongue portion 122 and the wire trench 118 are aligned. Furthermore, the terminal 104 can include a contacting arm 126 disposed thereon, and the contacting arm 126 extends opposite to the tongue portion 122 for coupling to a terminal of a mating connector.

Figure 2:
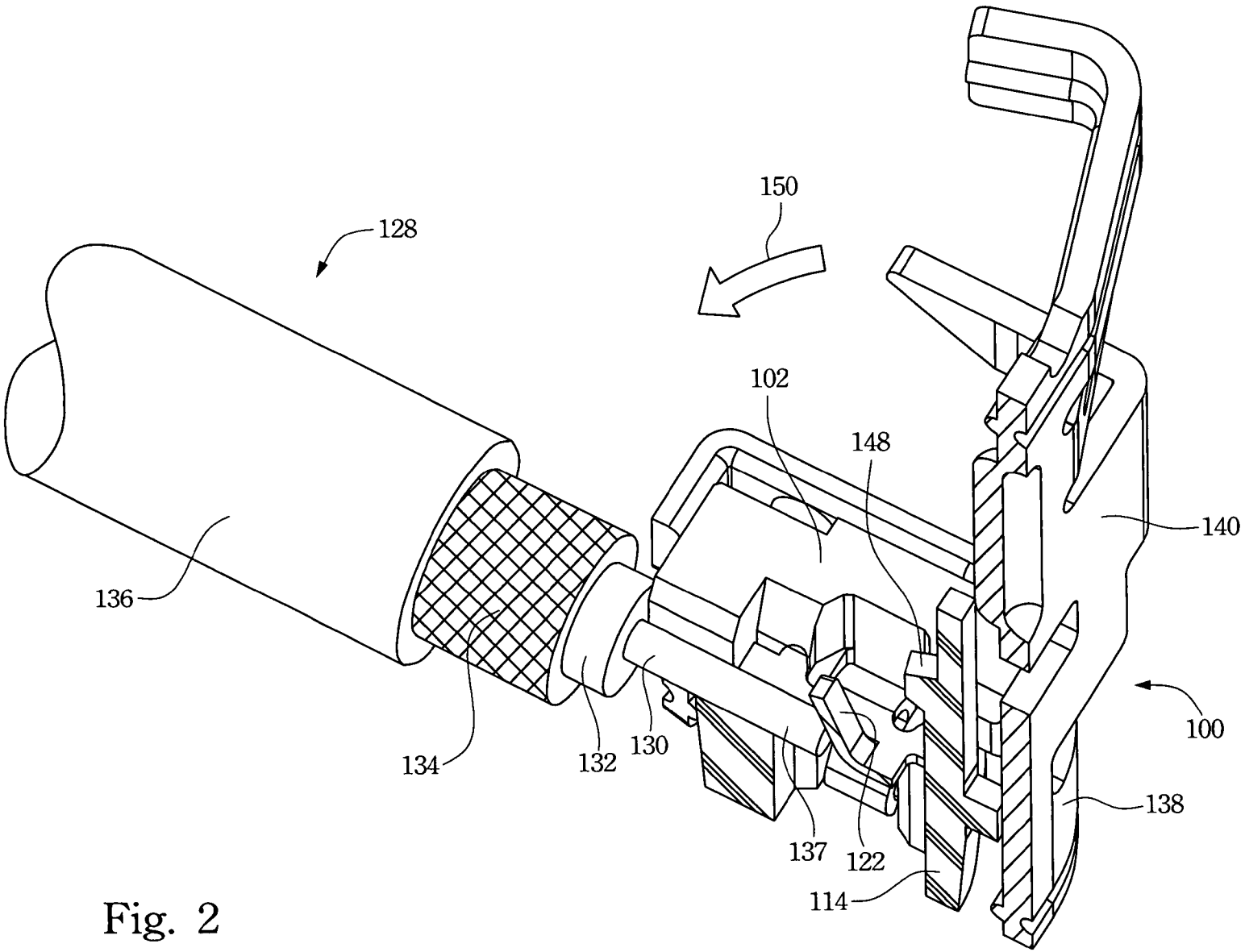
FIG. 2 illustrates a schematic view of a coaxial cable disposed on the preferred embodiment of the coaxial cable connector according to the present invention.

FIG. 2 illustrates a schematic view of a coaxial cable disposed on the preferred embodiment of the coaxial cable connector according to the present invention. It is worth noticing that the orientation of the coaxial cable connector 100 on the FIG. 2 is opposite to the orientation of the coaxial cable connector 100 on the FIG. 1. Refer to FIG. 1 and FIG. 2, the coaxial cable 128 gradually includes an internal conductor 130, an insulating layer 132, a metallic shield layer 134 and an insulating jacket 136 from inner to outer. When the coaxial cable 128 is disposed on the coaxial cable connector 100, the internal conductor 130 of the coaxial cable 128 is held by the wire trench 118 of the coaxial cable connector 100, and a terminal portion 137 of the internal conductor 130 is disposed between the tongue portion 122 and the opening 124.

Also refer to FIGS. 1 and 2, the conductive shell 106 includes a body 138 and a bending portion 140. The insulating housing 102 can be held in the body 138 of the conductive shell 106. The bending portion 140 is now positioned behind the insulating arm 114 while the tongue portion 122 is positioned in front of the insulating arm 114. That is to say, the insulating arm 114 is disposed between the bending portion 140 and the tongue portion 122.

Figure 3:
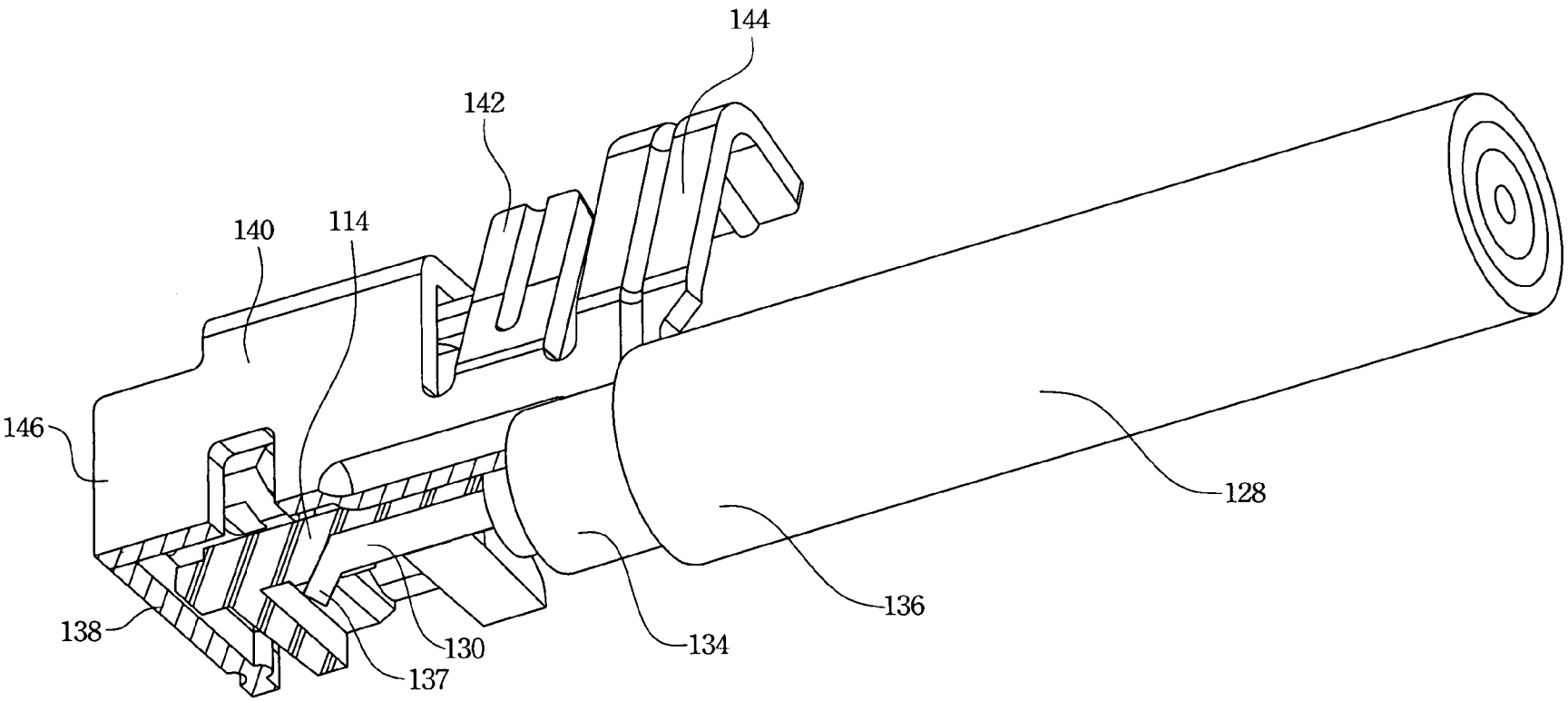
FIG. 3 illustrates a schematically sectional view of the coaxial cable coupled to the preferred embodiment of the coaxial cable connector according to the present invention

Refer to FIG. 3, a schematically sectional view of the coaxial cable coupled to the preferred embodiment of the coaxial cable connector according to the present invention is illustrated. The bending portion 140 includes, for example, at least one first holding portion 142 and at least one second holding portion 144. When the conductive shell 106 is bent along the direction indicated by the arrow 150, the conductive shell 106 is formed a bending fold 146 between the body 138 and the bending portion 140. At the moment, the first holding portion 142 is in contact with the metallic shield layer 134 of the coaxial cable 128, and the second holding portion 144 is in contact with the insulating jacket 136 of the coaxial cable 128. Furthermore, the bending portion 140 is bent to press on the insulating arm 114, and then the insulating arm 114 further presses on the tongue portion 122, and then the internal conductor 130. Therefore, the terminal portion 137 of the internal conductor 130 is pressed into the opening 124. Hence, the tongue portion 122 and the jaw portion 125 of the coaxial cable connector 100 can corporately hold the internal conductor 130 of the coaxial cable 128 to keep an electrical connection between the terminal 104 and the internal conductor 130.

In one preferred embodiment of the present invention, the insulating arm 114 includes, for example, a protrusion portion 148 correspondingly disposed to the tongue portion 122 to effectively press the tongue portion 122. Therefore, the terminal portion 137 of the internal conductor 130 can be pressed into the opening 124 due to the tongue portion 122 pressing down the terminal portion 137. The protrusion portion 148 of the tongue portion 122 can provide higher pressure on the terminal 104 and the internal conductor 130 to electrically connect together with a higher clamping force therebetween.

It is worth noticing that the second holding portion 144 can hold the insulating jacket 136 of the coaxial cable 128. Therefore, when the coaxial cable 128 is pulled and dragged, the second holding portion 144 and the insulating jacket 136 can effectively share the pulling and dragging force to effectively reduce the force acted on the internal conductor 130 and the breakage probability on the internal conductor 130.

The conventional coaxial cable connector utilizes the pair of contacts of the terminal to clamp the internal conductor of the coaxial cable that can generate a plurality of abnormal plastic deformation regions on the internal conductor. Therefore, the mechanical strength of the internal conductor is getting weak and the internal conductor is easy to break when the coaxial cable is pulled and dragged.

The coaxial cable connector according to the present invention can utilize the tongue portion of the terminal to press the internal conductor of the coaxial cable to suitably bend the internal conductor and keep the electrical connection between the internal conductor and the terminal. Furthermore, the loss of the mechanical strength of the internal conductor can be effectively reduced, with only a little loss at the bending corner of the internal conductor. Therefore, the coaxial cable connector, according to the present invention, can firmly connect the terminal to the internal conductor and effectively reduce the breakage probability on the internal conductor.

As is understood by a person skilled in the art, the foregoing preferred embodiments of the present invention are illustrative of the present invention rather than limiting of the present invention. It is intended that various modifications and similar arrangements be included within the spirit and scope of the appended claims, the scope of which should be accorded the broadest interpretation so as to encompass all such modifications and similar structures.

What is claimed is:

1. A coaxial cable connector, comprising:

an insulating housing having an insulating arm disposed thereon;

a terminal disposed in the insulating housing, having a tongue portion extending toward an extending direction of the insulating arm, a jaw portion and an opening on the terminal, one end of the tongue portion connecting to one side edge of the opening of the terminal and another end of the tongue portion protruding on one side of the opening; and a conductive shell having a body and a bending portion connected to the body, the body substantially holding the insulating housing and the bending portion disposed behind the insulating arm while the tongue portion is in front of the insulating arm;

wherein the insulating arm of the insulating housing comprises a protrusion portion positioned corresponding to the tongue portion of the terminal, when a coaxial cable is disposed on the coaxial cable connector and an internal conductor of the coaxial cable is disposed between the tongue portion and the opening, the bending portion of the conductive shell presses on the insulating arm of the insulating housing and the tongue portion of the terminal so as to press the tongue portion toward the opening of the terminal to connect with the internal conductor and the internal conductor is clamped by the tongue portion and the jaw portion.

2. The coaxial cable connector of claim 1, wherein the insulating housing comprises a base and an annular portion, the insulating arm and the annular portion are disposed on opposite surfaces of the base.

3. The coaxial cable connector of claim 2, wherein the base comprises a wire trench aligned to the insulating arm and the tongue portion.

4. The coaxial cable connector of claim 1, wherein the terminal further comprises a contacting arm disposed thereon, the contacting arm extending to a direction opposite the tongue portion for coupling to a corresponding connector.

5. The coaxial cable connector of claim 1, wherein the terminal further comprises at least one interference portion disposed thereon extending outwardly for locking to the insulating housing.

6. The coaxial cable connector of claim 1, wherein the jaw portion and the tongue portion are disposed on opposite sides of the opening.

7. The coaxial cable connector of claim 1, wherein the protrusion portion pressed on the tongue portion to further press a terminal portion of the internal conductor into the opening.

8. The coaxial cable connector of claim 1, wherein the bending portion comprises at least one first holding portion disposed thereon to clamp a metallic shield layer of the coaxial cable.

9. The coaxial cable connector of claim 1, wherein the bending portion comprises at least one second holding portion disposed thereon to clamp an insulating jacket of the coaxial cable.

10. A coaxial cable connector, comprising:

an insulating housing having a base, an insulating arm disposed on one surface of the base and an annular portion disposed on another surface of the base;

a terminal disposed in the insulating housing, having a tongue portion extending toward an extending direction of the insulating arm, a jaw portion and an opening on the terminal, one end of the tongue portion connecting to one side edge of the opening of the terminal and another end of the tongue portion protruding on one side of the opening; and a conductive shell having a body and a bending portion connected to the body, the body holding the insulating housing and the bending portion disposed behind the insulating arm while the tongue portion in front of the insulating arm;

wherein the insulating arm of the insulating housing comprises a protrusion portion positioned corresponding to the tongue portion of the terminal to effectively press the tongue portion, when a coaxial cable is disposed on the coaxial cable connector and an internal conductor of the coaxial cable is disposed between the tongue portion and the opening, the bending portion of the conductive shell presses on the insulating arm of the insulating housing and the tongue portion of the terminal so as to generate a bending fold on the conductive shell pressing between the bending portion and the body and press the tongue portion toward the opening of the terminal to connect with internal conductor and the internal conductor is clamped by the tongue portion and the jaw portion.

11. The coaxial cable connector of claim 10, wherein the base comprises a wire trench aligned to the insulating arm and the tongue portion.

12. The coaxial cable connector of claim 10, wherein the terminal further comprises a contacting arm disposed thereon, the contacting arm extending to a direction opposite the tongue portion for coupling to a corresponding connector.

13. The coaxial cable connector of claim 10, wherein the terminal further comprises at least one interference portion disposed thereon extending outwardly to lock to the insulating housing.

14. The coaxial cable connector of claim 10, wherein the bending portion comprises at least one first holding portion disposed thereon to clamp a metallic shield layer of the coaxial cable.

15. The coaxial cable connector of claim 10, wherein the bending portion comprises at least one second holding portion disposed thereon to clamp an insulating jacket of the coaxial cable.

* * * * *